US007740445B1

(12) United States Patent
Liang

(10) Patent No.: US 7,740,445 B1
(45) Date of Patent: Jun. 22, 2010

(54) TURBINE BLADE WITH NEAR WALL COOLING

(75) Inventor: George Liang, Palm City, FL (US)

(73) Assignee: Florida Turbine Technologies, Inc., Jupiter, FL (US)

( * ) Notice: Subject to any disclaimer, the term of this patent is extended or adjusted under 35 U.S.C. 154(b) by 628 days.

(21) Appl. No.: 11/821,136

(22) Filed: Jun. 21, 2007

(51) Int. Cl.
*F01D 5/18* (2006.01)

(52) U.S. Cl. ..... 415/173.5; 415/174.4

(58) Field of Classification Search ..... 415/115, 415/173.5, 174.4; 416/90 R, 92, 96 R, 97 R
See application file for complete search history.

(56) References Cited

U.S. PATENT DOCUMENTS 2,920,865 A 1/1960 Lombard
5,564,902 A 10/1996 Tomita
5,660,523 A * 8/1997 Lee ..... 416/97 R
5,941,687 A 8/1999 Tubbs
6,190,129 B1 2/2001 Mayer et al.
6,264,428 B1 7/2001 Dailey et al.
6,527,514 B2 3/2003 Roeloffs
6,602,052 B2 8/2003 Liang
6,790,005 B2 9/2004 Lee et al.
6,994,514 B2 2/2006 Soechting et al.
7,033,136 B2 4/2006 Botrel et al.
7,097,419 B2 8/2006 Lee et al.
7,118,342 B2 * 10/2006 Lee et al. ..... 416/97 R
7,270,514 B2 * 9/2007 Lee ..... 416/92
7,473,073 B1 * 1/2009 Liang ..... 415/173.5
7,494,319 B1 * 2/2009 Liang ..... 416/92

* cited by examiner

*Primary Examiner*—Igor Kershteyn
(74) *Attorney, Agent, or Firm*—John Ryznic

(57) ABSTRACT

A turbine blade with a plurality of near wall cooling channels on both the pressure side wall and suction side wall of the blade, and a plurality of tip cooling channels that open into a concave impingement cavity formed on the upstream side wall of a squealer tip rail that extends from the trailing edge and along the suction side wall of the blade, around the leading edge and ends on the pressure side wall just past the leading edge. The tip cooling channels provide cooling for the blade tip and inject the spent cooling air into the concave impingement cavity which then redirects the spent cooling air toward the oncoming hot gas flow leakage to produce a cushion against the hot gas flow to push the flow up and over the tip. Cooling air from a root supply cavity flows up through the plurality of suction side cooling channels to provide near wall cooling for the blade, then discharges into a cooling air collector cavity formed between the pressure and suction side walls. The cooling air then migrates toward the platform and then flows into the pressure side wall cooling channels to provide near wall cooling, and then into the tip cooling channels before discharging into the concave tip cavity that extends along the tip rail.

11 Claims, 6 Drawing Sheets

TURBINE BLADE WITH NEAR WALL COOLING

CROSS-REFERENCE TO RELATED APPLICATIONS

This application is related to U.S. patent Regular Utility application Ser. No. 11/503,546 filed Aug. 11, 2006 by Liang and entitled TURBINE BLADE WITH A NEAR-WALL COOLING CIRCUIT; and to U.S. patent Regular Utility application Ser. No. 11/600,452 filed on Nov. 16, 2006 by Liang and entitled TURBINE BLADE WITH NEAR WALL SPIRAL FLOW SERPENTINE COOLING CIRCUIT; and to U.S. patent Regular Utility application Ser. No. 11/654,124 filed on Jan. 17, 2007 by Liang and entitled NEAR WALL COMPARTMENT COOLED TURBINE BLADE; and to U.S. patent Regular Utility application Ser. No. 11/453,432 filed on Jun. 14, 2006 by Liang and entitled TURBINE BLADE WITH COOLED TIP RAIL; and to U.S. patent Regular Utility application Ser. No. 11/600,449 filed on Nov. 16, 2006 by Liang and entitled TURBINE BLADE TIP RAIL COOLING CIRCUIT; and to U.S. patent Regular Utility application Ser. No. 11/510,141 filed on Aug. 25, 2006 by Liang and entitled TURBINE BLADE TIP CONFIGURATION all of which are incorporated herein by reference.

BACKGROUND OF THE INVENTION

1. Field of the Invention

The present invention relates generally to fluid reaction surfaces, and more specifically to turbine airfoils with cooling circuits.

2. Description of the Related Art Including Information Disclosed Under 37 CFR 1.97 and 1.98

In a gas turbine engine, especially in an industrial gas turbine engine, a hot gas flow generated in a combustor is passed through a series of rows or stages of turbine stator vanes and rotor blades to convert the thermal energy of the flow into mechanical energy by driving the rotor shaft. The efficiency of the engine can be increased by passing a higher hot gas flow through the turbine. However, the maximum temperature is dependent upon the material properties of the turbine airfoils, especially the first stage vanes and blades because these are exposed to the hottest temperature.

Turbine airfoils can be exposed to higher temperatures than the material properties would allow by passing pressurized cooling air through the airfoils to produce convection cooling, impingement cooling and film cooling of the airfoils. Maximizing the amount of airfoil cooling while minimizing the amount of cooling air used would provide the maximum efficiency for the engine. The rotor blades also are exposed to high gas flow temperatures at the blade tip because of leakage flow. High temperature turbine blade tip section heat load is a function of the blade tip leakage flow. A high leakage flow will induce high heat load onto the blade tip section and therefore the blade tip section sealing and cooling have to be addressed as a single problem. A prior art turbine blade tip includes a squealer tip rail which extends around the perimeter of the airfoil flush with the airfoil wall and forms an inner squealer pocket. FIG. 3 shows a prior art turbine blade with this type of squealer tip design. The main purpose for incorporating a squealer tip in the blade design is to reduce the blade tip leakage and also to provide a rubbing capability for the blade. The squealer tip rail is thin compared to a solid blade tip and therefore rubbing causes less damage to the tip or the shroud surface.

FIG. 2 shows a prior art blade with a squealer tip cooling design. Film cooling holes are built in along the airfoil pressure side tip section. Also, convective cooling holes are positioned along the tip rail at the inner portion of the squealer pocket to provide additional cooling for the squealer tip rail. Secondary hot gas flow migration around the blade tip section is shown by the arrows in FIG. 2.

FIG. 3 shows a prior art blade tip with cooling design for the blade suction side tip rail. The suction side blade tip rail is subject to heating from three exposed sides, and cooling of the suction side squealer tip rail by means of a discharge row of film cooling holes along the pressure side peripheral and at the bottom of the squealer floor becomes insufficient. This is primarily due to the combination of tip rail geometry and the interaction of hot gas secondary flow mixing; the effectiveness induced by the pressure side film cooling and tip section convective cooling holes is very limited.

Turbine blade cooling not only allows for a higher gas flow temperature exposed to the airfoil, but also reduces the occurrence of hot spots around the blade that leads to erosion and spallation, thus shortening the life of the blade.

It is therefore an object of the present invention to provide for a turbine blade with a near wall cooling circuit and a squealer tip cooling design that can be used in a blade cooling design in addition to a passive clearance control system, especially for the blade design with a single suction side tip rail.

BRIEF SUMMARY OF THE INVENTION

The blade tip leakage flow and cooling problems described above in the cited prior art can be alleviated by the blade sealing and cooling design of the present invention within the blade tip geometry and the suction side tip rail cooling design. The unique blade tip configuration of the present invention is constructed with a single tip rail that wraps around the blade leading edge diameter and then follows around the airfoil suction side wall contour and terminates at the blade trailing edge. Also, a semi-circular concave shaped secondary flow deflector is used on the upstream surface of the tip rail to increase the sealing and cooling of the blade tip suction side single tip rail.

The cooling flow circuit comprises a series of near wall radial cooling channels on the suction side of the airfoil wall and followed by a series of near wall radial cooling channels on the pressure side wall coupled with a series of cooling channels across the blade tip section. Cooling airs is fed from the blade dovetail cavity and into multiple series near wall cooling channels through an elbow bend entrance section, flowing through the airfoil suction side radial channels to provide blade suction side region cooling first. Cooling air exits from the suction side radial channel to impinge onto the backside of the bottom portion of the suction side tip rail floor first. The spent cooling air is then discharged into the blade mid-chord section collection cavities. Cooling air is then fed into the airfoil pressure side radial flow channels to provide blade pressure side region cooling, and then turns toward the airfoil suction side through the blade squealer tip floor to provide cooling for the blade squealer tip. The spent cooling air is then discharged from the near wall squealer tip cooling channels and impinged onto the concave surface on the frontal area of the blade suction side tip rail.

In addition, a portion of the cooling air will then flow through the airfoil leading edge to provide a showerhead film cooling for the blade. a portion of the cooling air will also flow through the airfoil trailing edge cooling holes to provide airfoil trailing edge cooling prior to being discharged from the airfoil trailing edge.

DETAILED DESCRIPTION OF THE INVENTION

Figure 1:
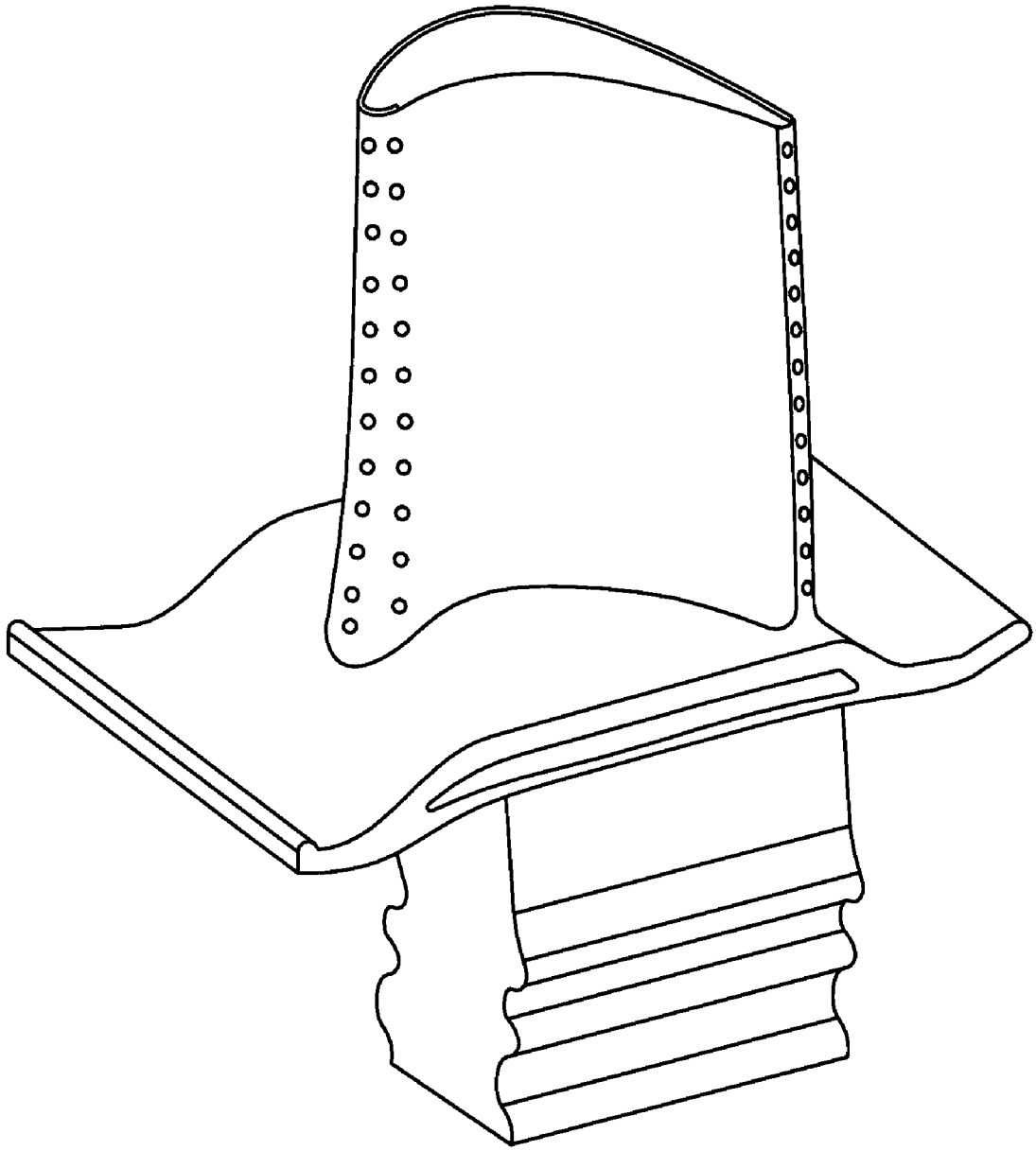
FIG. 1 shows a schematic view of a turbine blade in which the cooling design of the present invention is used.
Figure 2:
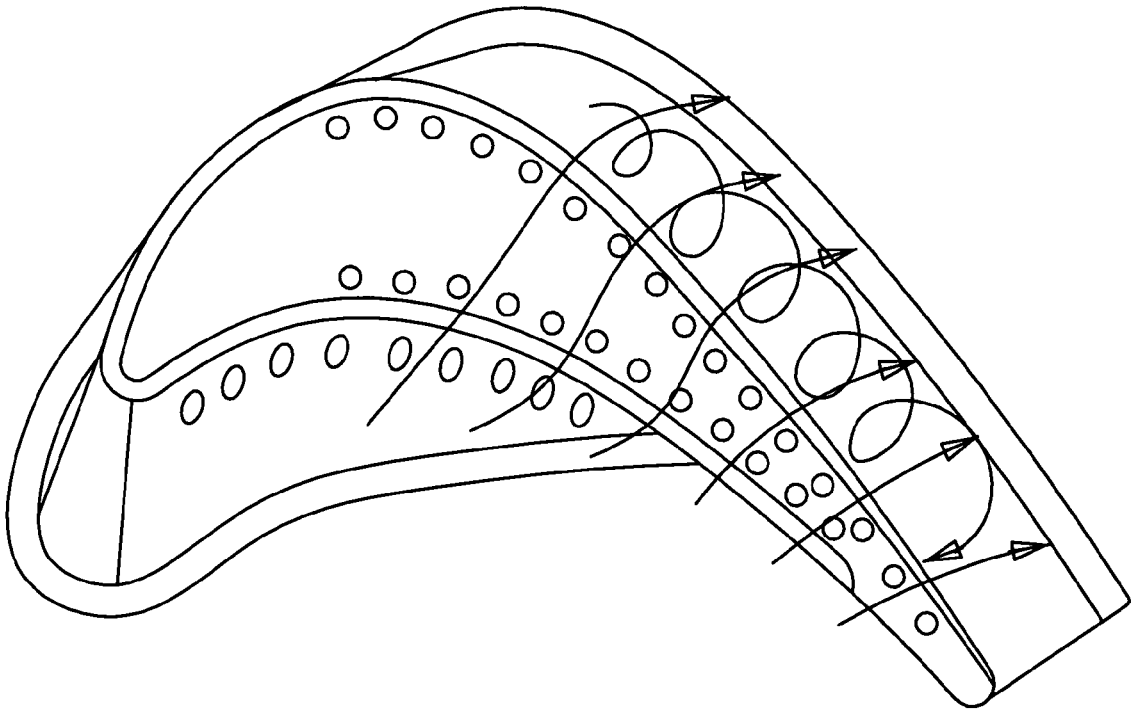
Fig 2 Prior Art
FIG. 2 shows a top view of a prior art turbine blade with a squealer tip.
Figure 3:
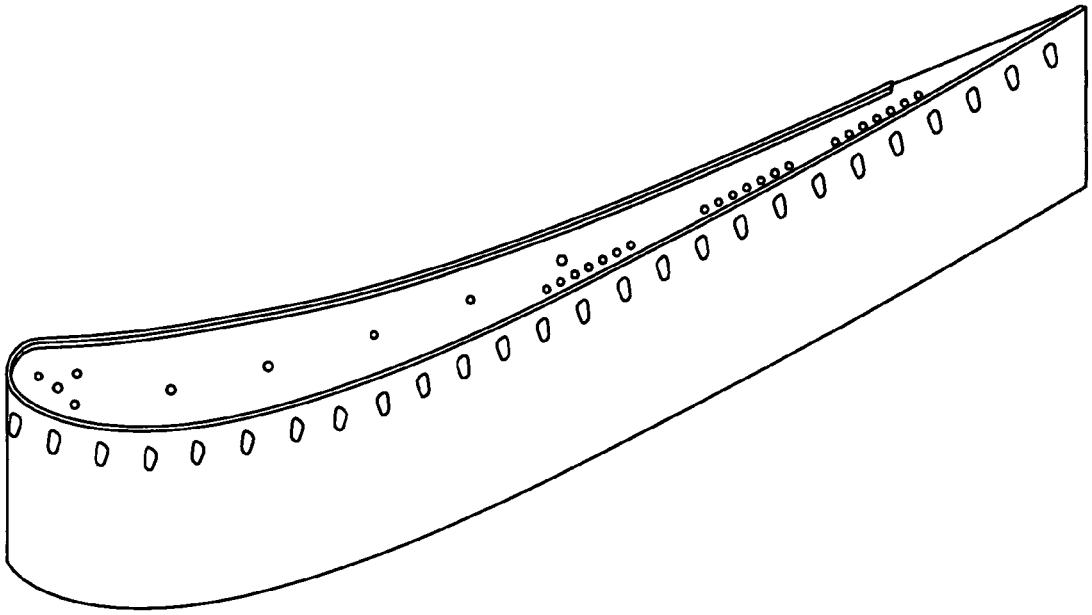
Fig 3 Prior Art
FIG. 3 shows a prior art turbine blade suction side tip rail cooling design.
Figure 4:
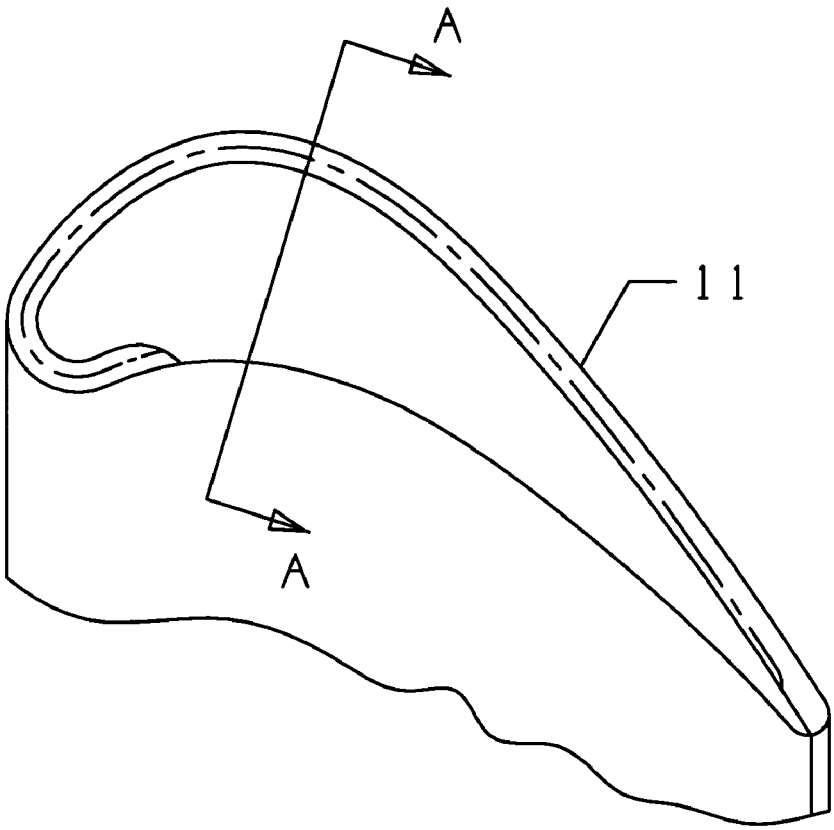
FIG. 4 shows a turbine blade tip cooling and sealing design of the present invention.
Figure 5:
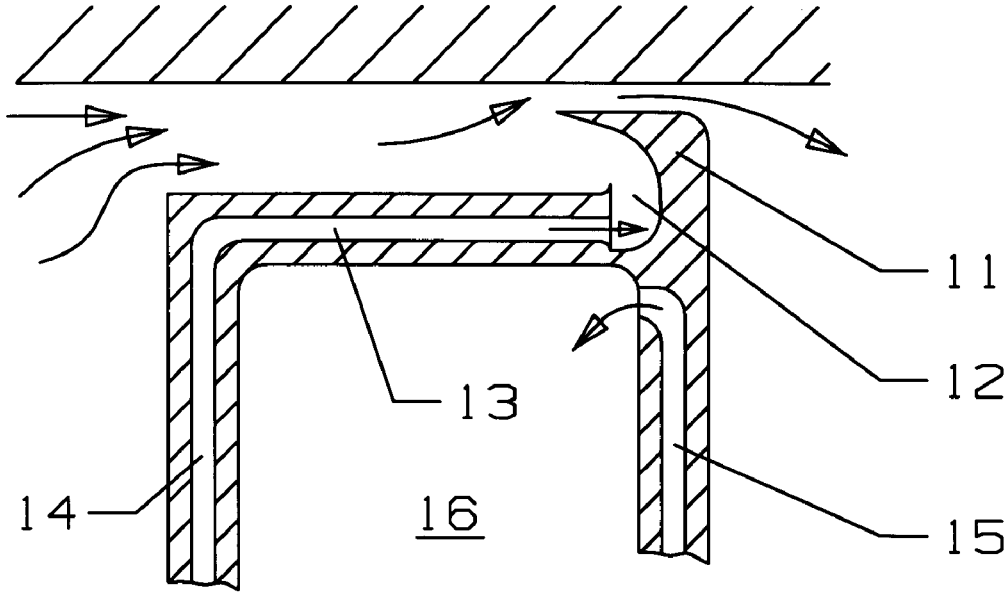
FIG. 5 shows a cross section view of the squealer tip cooling design of the present invention.

The present invention is a turbine blade used in a gas turbine engine in which the blade includes internal cooling channels and blade tip cooling. FIG. 4 shows a schematic view of the turbine blade tip having the cooling passages of the present invention. The blade tip includes a suction side tip rail 11 that extends from the trailing edge and extends on the pressure edge just past the leading edge of the blade. FIG. 5 shows a cross section view through the side of the suction side tip rail 11 with a concave impingement cavity 12, a blade tip near wall cooling channel 13 extending across the blade tip just below the pocket floor, a pressure side near wall channel 14, a suction side near wall channel 15 and a cooling air collector cavity 16. The suction side cooling channel 15 opens into the collector cavity 16 to discharge the cooling air. The concave impingement cavity 12 creates a backward splash flow to be described below. The outlet of the blade tip cooling channel 13 creates an impingement jet opening into the concave impingement cavity 12.

Figure 6:
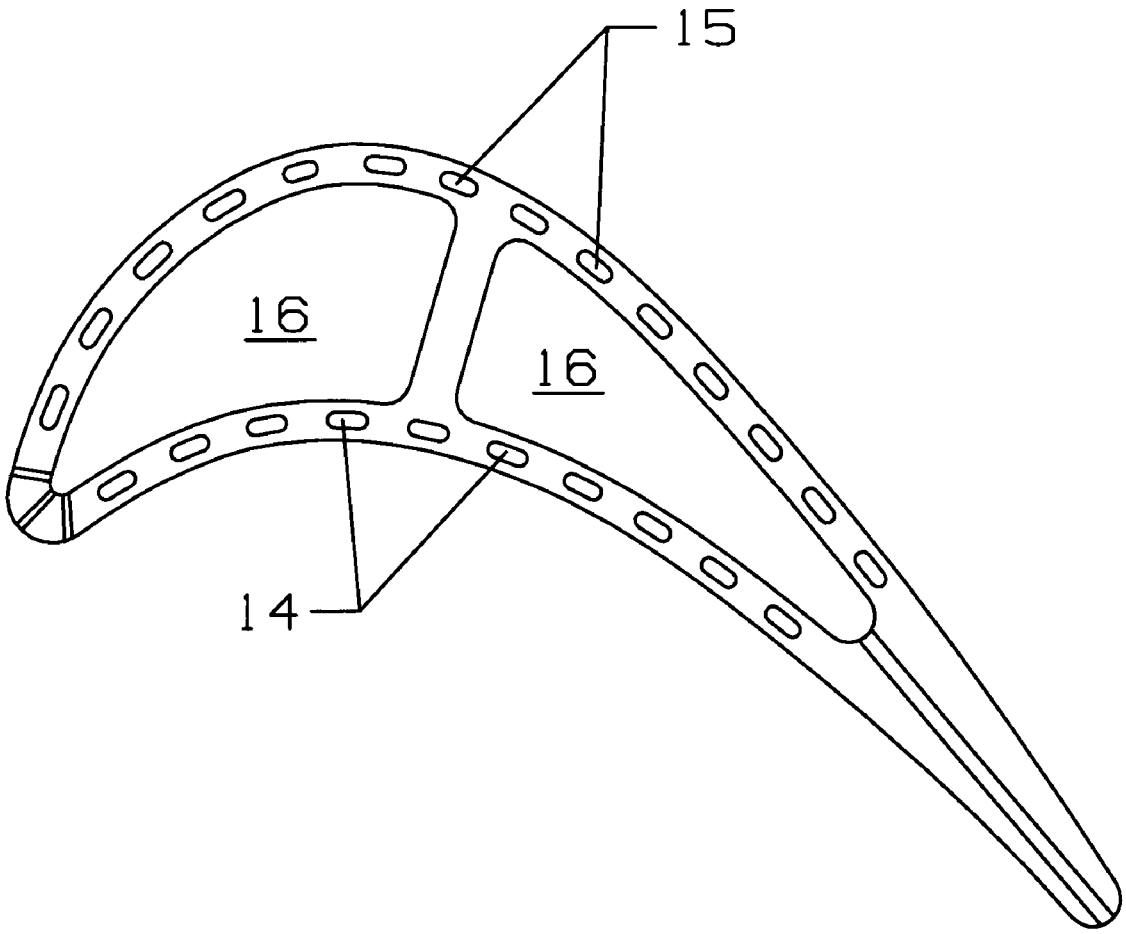
FIG. 6 shows a cut away view of the near wall turbine blade cooling circuit of the present invention.

FIG. 6 shows the turbine blade of the present invention from a cut-away view with the pressure side and the suction side having the cooling channels. The pressure side cooling channels 14 extend along the pressure side wall and the suction side cooling channels 15 extend along the suction side wall of the blade. One or more cooling air collector cavities 16 are formed within the blade and separated by ribs that extend across the walls. A showerhead arrangement of film cooling holes are located on the leading edge region, and a row of exit holes are located on the trailing edge region with each connected to the adjacent collector cavity.

Figure 7:
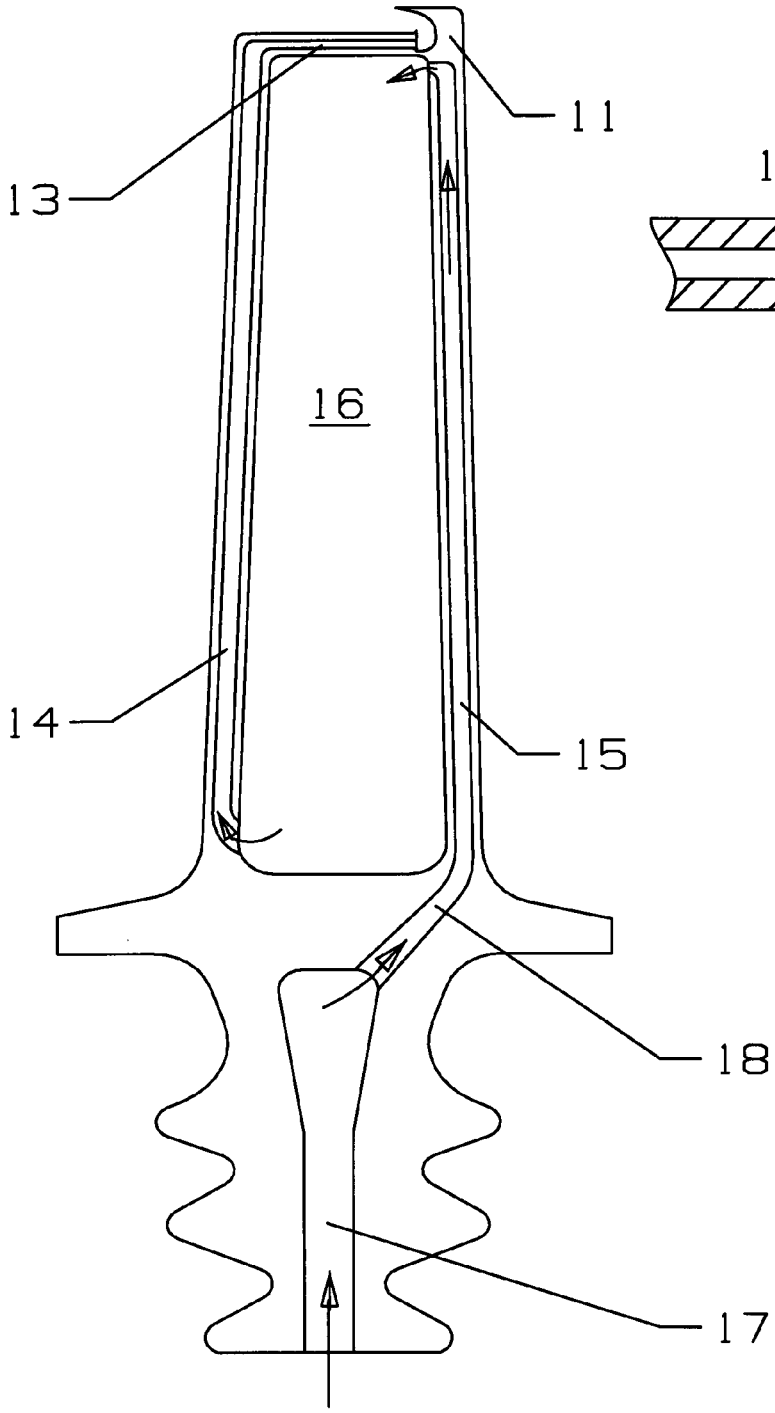
FIG. 7 shows a cross section view of the turbine blade cooling circuit of the present invention.
Figure 8:
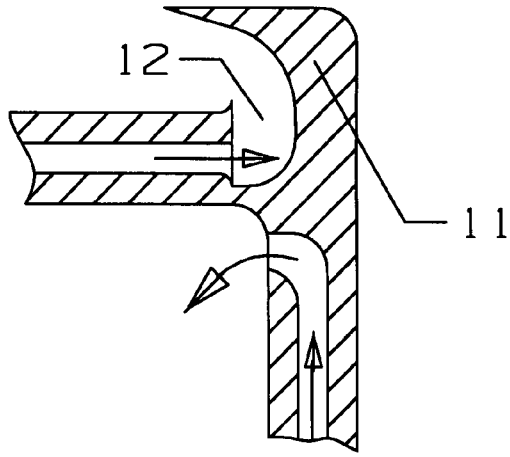
FIG. 8 shows a detailed view of the suction side tip rail with the cooling circuit of the present invention.

FIG. 7 shows a cross section view of the entire blade with the cooling circuit for the present invention. The suction side tip rail 11 and the concave impingement cavity 12 are located along the suction side of the blade. A cooling air supply cavity 17 is located in the blade root to supply pressurized cooling air used to cool the blade. A suction side near wall channel 18 connects the supply cavity 17 to the suction side cooling channel 15 extending along the suction side wall of the blade. Each suction side cooling channel 15 is connected to a supply channel 18. The pressure side near wall cooling channel 14 extends along the pressure side wall of the blade and flows into the tip cooling channel 13 which then opens into the concave impingement cavity 12. FIG. 8 shows a detailed view of the suction side near wall cooling channel exit and the tip cooling channel exit into the concave cooling cavity 12 on the tip rail 11.

In operation, due to the pressure gradient across the airfoil from the pressure side to the suction side, the secondary flow near the pressure side surface is migrated from the lower blade span upward across the blade end tip.

On the pressure side corner of the airfoil location, the secondary leakage flow entering the squealer pocket acts like a developing flow at a low heat transfer rate and velocity. Since the floor of the squealer tip at the entrance section is higher than the spacing in-between the suction side tip rail and the blade outer air seal, the secondary leakage flow will be accelerated across the blade tip but at a lower through flow velocity at the forward portion of the squealer floor. This allows for cooling of the blade squealer tip entrance region with the multiple near wall cooling channels.

With a taller squealer tip floor, the near wall secondary leakage flow has to flow outward when it enters the suction side tip rail. The spent cooling air discharged from the near wall cooling channels impinges onto the concave surface and therefore creates a backward splash flow which acts against the on-coming streamwise leakage flow. The interaction of the blade leakage flow with the spent impingement cooling air pushes the leakage flow upward by the backward splash cooling flow from the frontal side of the suction side tip rail prior to entering the suction side tip rail squealer channel. The backward splash spent impingement cooling air also creates an aerodynamic air curtain to block the leakage flow over the suction side tip rail 11. In addition to the counter flow action, the concave geometry with acute angle corner for the blade end tip geometry forces the secondary flow to bend outward as the leakage enters the suction side tip corner and yields a smaller vena contractor, and therefore reduces the effective leakage flow area. The end result for this combination of effects is to reduce the blade leakage flow.

The tip rail cooling design plus the leakage flow resistance effect by the suction side blade tip end geometry and cooling flow ejection of the present invention yields a very high resistance for the leakage flow path and therefore reduces the blade leakage flow and improves the blade tip section cooling, which thus reduces the blade tip section cooling flow requirement.

I claim the following:

1. A turbine blade for use in a gas turbine engine, the blade comprising:

a blade tip with a squealer tip rail extending along the suction side wall of the blade;

a concave impingement cavity formed on the upstream side of the tip rail and extending along the tip rail, the concave impingement cavity having a shape to redirect cooling air against the hot gas flow passing over the tip; and, a plurality of blade tip cooling channels extending along the blade tip and opening into the concave impingement cavity such that cooling air passing through the tip cooling channels flows into the concave impingement cavity.

2. The turbine blade of claim 1, and further comprising:

a plurality of pressure side wall cooling channels extending along the pressure side wall of the blade, each of the plurality of blade tip cooling channels being connected to a separate pressure side cooling channel.

3. The turbine blade of claim 2, and further comprising:

the pressure side cooling channels are connected to a cooling air collector cavity formed within the blade between the pressure side wall and the suction side wall.

4. The turbine blade of claim 3, and further comprising:

a plurality of suction side wall cooling channels extending along the suction side wall of the blade, the suction side wall cooling channels discharging the cooling air into the cooling air collector cavity.

5. The turbine blade of claim 4, and further comprising:

the plurality of suction side wall cooling channels are connected to a cooling air supply cavity in the root of the blade to supply pressurized cooling air from a source external to the blade and into the plurality of suction side wall cooling channels.

6. The turbine blade of claim 3, and further comprising:

the plurality of pressure side wall cooling channels extending along the pressure side wall of the blade along substantially the entire pressure side airfoil surface to provide near wall cooling for the blade.

7. The turbine blade of claim 4, and further comprising:

the plurality of suction side wall cooling channels extending along the suction side wall of the blade along substantially the entire suction side airfoil surface to provide near wall cooling for the blade.

8. The turbine blade of claim 1, and further comprising:

the tip rail extends from the trailing edge of the blade around the leading edge and stops on the suction side just past the leading edge of the blade.

9. The turbine blade of claim 1, and further comprising:

the concave impingement cavity is formed with a lip on the outer end of the tip rail that extends farther toward the upstream side than the opening of the tip cooling channels.

10. The turbine blade of claim 1, and further comprising:

the concave impingement cavity is formed with a lip on the outer end of the tip rail at such an angle that the hot gas leakage flow over the blade tip is pushed upward form the frontal side of the suction side tip rail prior to the flow entering the suction side tip rail squealer channel.

11. The turbine blade of claim 1, and further comprising:

the concave impingement cavity is formed with a lip on the outer end of the tip rail at such an angle that the spent impingement cooling air creates an aerodynamic air curtain to block the leakage flow over the suction side tip rail.

* * * * *